US008523440B2

(12) United States Patent
Walker et al.

(10) Patent No.: US 8,523,440 B2
(45) Date of Patent: Sep. 3, 2013

(54) DISPOSABLE SEAL AND LOCK BEVERAGE POUCH

(75) Inventors: Eileen Walker, Monroe, NY (US); Kim Maguire, Katonah, NY (US)

(73) Assignee: Bevi Corporation, Monroe, NY (US)

( * ) Notice: Subject to any disclaimer, the term of this patent is extended or adjusted under 35 U.S.C. 154(b) by 385 days.

(21) Appl. No.: 12/381,464

(22) Filed: Mar. 12, 2009

(65) Prior Publication Data

US 2009/0180718 A1 Jul. 16, 2009

Related U.S. Application Data

(63) Continuation-in-part of application No. 11/233,658, filed on Sep. 23, 2005, now abandoned.

(60) Provisional application No. 60/686,723, filed on Jun. 2, 2005.

(51) Int. Cl.
*B65D 33/00* (2006.01)
*B65D 65/26* (2006.01)

(52) U.S. Cl.
USPC ..... 383/202; 383/203; 383/61.1

(58) Field of Classification Search
USPC ..... 383/121, 202, 5, 61.1, 84–88, 203–209
See application file for complete search history.

(56) References Cited

U.S. PATENT DOCUMENTS 3,545,604 A * 12/1970 Gunther, Jr. ..... 206/217
RE28,969 E 9/1976 Naito
4,072,233 A 2/1978 Kramer et al.
4,172,914 A 10/1979 Festag et al.
4,378,069 A 3/1983 Franco
4,498,591 A 2/1985 Smith, II
4,557,377 A * 12/1985 Maloney ..... 206/219
4,762,514 A 8/1988 Yoshida
4,782,951 A 11/1988 Griesbach et al.
5,417,495 A * 5/1995 Branson ..... 383/63
5,421,485 A * 6/1995 Furuta et al. ..... 222/95
5,425,583 A 6/1995 Wild
5,816,709 A 10/1998 Demus
5,833,368 A * 11/1998 Kaufman ..... 383/205
5,873,656 A * 2/1999 Arkins et al. ..... 383/202
5,997,177 A * 12/1999 Kaufman ..... 383/5
6,010,244 A * 1/2000 Dobreski et al. ..... 383/63
6,076,967 A 6/2000 Beaudette
6,116,782 A * 9/2000 Arkins et al. ..... 383/202
6,332,712 B1 * 12/2001 Headley ..... 383/64
6,375,002 B2 * 4/2002 Edwards ..... 206/217
6,419,393 B1 * 7/2002 Shibata ..... 383/202
6,652,144 B2 11/2003 Stefandl
6,851,578 B2 2/2005 Hagihara
6,883,683 B1 4/2005 Cunningham et al.

(Continued)

*Primary Examiner* — Jes F Pascua
*Assistant Examiner* — Peter Helvey
(74) *Attorney, Agent, or Firm* — Karl F. Milde, Jr.; Eckert Seamans Cherin & Mellott, LLC

(57) ABSTRACT

A fillable, sealable, disposable container for storing, transporting and consuming a liquid, such as an individual beverage serving, has opposed front and back walls joined along their opposed sides. Each wall has an upper portion, defining an opening for filling the container, and a lower portion, connecting the lower portions of the front and back walls, for stabilizing the container for filling. A sealable fluid-tight liquid retaining seal is provided at the opening, for sealing the container when filled. Means are provided for creating a hole in the front wall of the container to extract the liquid.

12 Claims, 9 Drawing Sheets

(56) References Cited

U.S. PATENT DOCUMENTS

| | | | | |
|---|---|---|---|---|
| 6,913,388 | B2 | 7/2005 | Laske | |
| D582,790 | S | 12/2008 | Friebe et al. | |
| 7,648,023 | B2 * | 1/2010 | Maguire et al. | 206/207 |
| 2002/0114543 | A1 * | 8/2002 | Murray | 383/202 |
| 2003/0221393 | A1 | 12/2003 | Kothari | |
| 2004/0161177 | A1 * | 8/2004 | N'Dia | 383/202 |
| 2005/0175262 | A1 * | 8/2005 | Nishibe et al. | 383/202 |
| 2006/0056744 | A1 * | 3/2006 | Berman | 383/66 |
| 2006/0280391 | A1 * | 12/2006 | Buggs | 383/203 |
| 2006/0285782 | A1 * | 12/2006 | Walker et al. | 383/200 |
| 2007/0154117 | A1 * | 7/2007 | Murray | 383/66 |
| 2008/0233252 | A1 * | 9/2008 | Manning et al. | 426/412 |
| 2009/0180718 | A1 * | 7/2009 | Walker et al. | 383/202 |

* cited by examiner

DISPOSABLE SEAL AND LOCK BEVERAGE POUCH

CROSS-REFERENCE TO RELATED APPLICATIONS

This application claims priority from Provisional Patent Application No. 60/686,723, filed Jun. 2, 2005.

This application is a continuation-in-part of application Ser. No. 11/233,658 filed Sep. 23, 2005 now abandoned and entitled "DISPOSABLE SEAL AND LOCK FOIL BEVERAGE POUCH AND THE OPERATING MACHINERY TO MANUFACTURE SUCH PRODUCT."

FIELD OF THE INVENTION

The present invention relates to a fillable, sealable container for a fixed amount of a liquid, such as a serving of a beverage.

BACKGROUND OF THE INVENTION

Individual servings of beverages, such as juices, are sold in disposable pouches or boxes, ideal for storing, transporting and/or consuming the single serving of the beverage. The pouches, which are made of fluid-impervious laminar materials, are not re-usable. An example of the laminar materials from which beverage pouches are currently being manufactured is constructed as follows. Beginning with the outer layer, the film consists of a polyester film/printing ink/coating adhesive/metal foil/coating adhesive/heat-sealable plastic (e.g., polyethylene) film. Such a laminate is further described in the U.S. Pat. No. 5,425,583 to Wild, which patent is incorporated herein by reference. This patent also teaches the provision of a separate layer of easily pierced material on the inside of the laminate film, covering an opening in the laminate film, to facilitate the insertion of a drinking straw in the bag while preventing the liquid contents from leaking out.

Another example of the laminar materials from which such pouches are manufactured is disclosed in U.S. Pat. No. 6,851,578 to Hagihara, which patent is also incorporated herein by reference. This material consists of a plastic sheet, a metallic sheet or a composite sheet composed of the former sheets; the plastic sheet is exemplified by polyethylene, polypropylene, polyester, polycarbonate or a nylon resin.

In U.S. Pat. No. 6,652,144 to Stefandl, which is also incorporated herein by reference, the fluid container pouch is described as comprising two opposing pliable sidewalls, formed of a composite material, such as a polypropylene ply having a barrier layer of aluminum foil, a metalized coating, or polyethylene vinyl alcohol, on at least one side of the polypropylene ply. The upper end of a straw, included inside the pouch, can be exposed for use by tearing flap at the top of the pouch.

U.S. Pat. No. 4,378,069 to Franco describes a thin-walled pouch container made of synthetic resins such as polyethylene, polypropylene, and similar flexible plastics susceptible to heat sealing. U.S. Pat. No. 4,172,914 to Festag et al. discloses beverage pouches constructed of aluminum/plastic laminate foil. Indeed, most disposable beverage pouches are heat sealed along their side walls, the plastic layers being used for heat sealing of the front and back surfaces of the pouch as well as fluid imperviousness. These two references are also incorporated herein by reference.

Access to the beverage in the pouch is typically achieved with a straw attached to the container. This straw may be separated from the container and used to pierce the pouch and sip the beverage. However, it is not easy to pierce the wall of a pouch constructed of multi-layer laminar materials.

U.S. Pat. No. 4,762,514 to Yoshida et al. discloses a method of making a beverage packaging bag comprising laminar panels of a combination of polyester film, polypropylene film, nylon film, cellophane, or aluminum foil, capable of being readily pierced by a straw.

U.S. Pat. No. 6,076,967 to Beaudette discloses a fillable disposable beverage bag or pouch having several different embodiments for attaching a drinking straw. One is built into the wall of the bag; another is a round opening with a removable adhesive patch.

U.S. Pat. No. 4,072,233 to Kramer et al. describes another method for creating a piercing point in a container made of a plurality of layers of laminated material. One of the container walls is provided with a piercing point constructed by forming a depression in the exterior surface of the container wall. The depression does not penetrate completely through the wall. The depression is surrounded by an annular ring, which marks its location.

U.S. Patent Publication No. 2003/0221393 to Kothari describes a conventional aluminum foil beverage container which possesses a round hole provided at a top side face, covered with a thin film of aluminum that can be pierced by a straw.

A variety of closures for flexible storage bags and pouches have been developed including the so-called profile closure having at least one pair of mating channels, an example of which may be seen in U.S. Pat. Re. 28,969 to Naito which shows the Zip-loc storage bag. U.S. Pat. No. 4,782,951 to Griesbach et al. discloses embedding a plastic zipper on the inside surface of a storage pouch, by attaching interlocking closure strips or profiles on inside surfaces of said front and back walls, adjacent to the areas of said front and back walls to become sealed after filling. No "straw holes" are provided in these storage pouches.

U.S. Pat. No. 6,883,683 to Cunningham et al. describes a pouch with front and back walls tack sealed together along a line proximal the top edge to releasably close the opening of the pouch. When the tack seal is broken, the front and back walls may be separated from one another to open the pouch, and the pouch resealed by pressing together the front and back walls over the tack seal. Again, no "straw holes" are provided in these storage pouches. Recently, storage bags have been provided with a bottom surface, making it possible to stand the pouch upright on a counter, and place items/food to be stored through the sealable opening.

U.S. Pat. No. 4,498,591 to Smith discloses a pouch construction wherein carefully placed lines of deformation in the pouch create an opening at the top of the pouch, by merely applying pressure against the two opposed sides of the pouch, toward one another.

U.S. Pat. No. 6,913,388 to Laske discloses a flexible container formed of two sheets sealed together along their edges to form a void between them. The seal comprises an adhesive sealing line on the outside upper surface of the front wall. The seal is formed by folding the upper portions of the front and back walls onto the front wall and securing the fold with an adhesive seal.

U.S. Pat. No. 5,816,709 to Demus discloses a container having a protective secondary seal by folding the upper portions of the front and back walls onto the front wall and securing the fold with a hook and loop fastener.

U.S. Design Pat. No. D582,790 to Friebe et al. shows a "foil package" having an attached straw and circular markings indicating the position for insertion of the straw. It is not possible to discern from the drawings how the straw is to be inserted in the foil.

While all of the bags and pouches are attractive and convenient, manufacturers and sellers of the pouches, the markup for the pouch is inordinately high considering the cost of the pouch and the beverage contained in the pouch.

One alternative to the disposable pouch is a reusable plastic container such as a sipper-cup construction. These alternative structures need repeated washings, and, if constructed of plastic, may become discolored and acquire an unpleasant smell. Another alternative is glass containers, which do not have these disadvantages, but bring the danger and inconvenience of breaking.

SUMMARY OF THE INVENTION

It is a principal object of the present invention to provide fillable, sealable, containers for liquids, especially individual serving of a beverage. It is a further object of present invention to provide such a container which is both inexpensive and disposable. It is a still further object of the invention to provide a "straw hole" in the container, for piercing the container with a straw; and to provide a straw attached to the container, or means for attaching a straw to the container.

These objects, as well as other objects which will become apparent from the discussion that follows, are achieved, in accordance with the present invention, the first embodiment of which comprises a fillable, sealable, disposable container, comprising opposed front and a back walls of fluid impervious material, each wall having an upper portion, opposed side edges, and a lower portion, and a bottom wall between the lower portions of the front and back wall. In one preferred embodiment, the front and back walls are joined along the opposed side edges, leaving a liquid receiving opening between the upper portions of the front and back walls. In another preferred embodiment, the upper portion of the back wall is folded over to overlap the upper portion of the front wall, and the walls are joined along the opposed side edges, to create a pouch with a liquid receiving opening in the upper portion of the front wall. The pouch, or container, is provided with a sealable fluid-tight liquid retaining seal about said liquid receiving opening, for sealing a liquid portion, or serving, in the container. The pouch or container is also provided with means for creating a hole in the front wall of the container, beneath the upper portion of the front wall, for extracting the liquid through the hole, such as with a straw. The liquid receiving opening maintains an effective pouring diameter, while the container is supported on its bottom stabilizing surface.

The sealable fluid-tight liquid retaining seal may be a mating channel closure, such as a Ziploc seal, or an adhesive seal on the inside surface of the upper portion of at least one of the front wall and the back walls. The pouch or container may also be provided with a protective secondary seal, comprising adhesive on the outside surface of the upper portion of the front wall, for attaching the front wall to itself about a fold in the upper portions of the front and back walls.

The bottom stabilizing surface may comprise a pleat in the connecting bottom wall, the sides of which are secured to each other, but not to the side edges of the front and back walls, creating a two legged gusset. Alternatively, the bottom stabilizing surface may comprise a pleat in the connecting bottom wall, the edges of which are sealed to the lower portion of the front and back walls, along their side edges. In still another embodiment, the bottom stabilizing surface is flat wall, such as an ovate blank. When the container is supported on its bottom stabilizing surface the liquid receiving opening can remain open, maintaining an effective pouring diameter.

The pouch or container has means for creating a hole in the front wall of the container, such as an area of weakening in the front wall, below the liquid retaining means; or an opening in the front wall, below the liquid retaining means, with a removable tab forming a fluid-tight seal over the hole; or a circular mating channel closures in the tab and about the hole.

In another embodiment of the fillable, sealable, disposable pouch or container for a liquid of the present invention, the container is provided with a liquid receiving opening in the upper portion of the front wall, comprising a mating channel closure. Such a container may also be provided with a secondary seal, as described above, and a pleated, gusseted, or ovate, bottom stabilizing surface. Said liquid receiving opening maintains an effective pouring diameter, while the container is supported on its bottom stabilizing surface. In addition, the container may be provided with at least one score line traversing the top channel of the mating channel closure, and/or at least one score line traversing the bottom channel of the mating channel closure, to increase the effective pouring diameter of the opening. Such a container may be manufactured by sealing a mating channel closure to the front panel, on the inner surface or the outer surface, preferably before the container is fully formed. A line of weakening or perforations may underlie the closure, to aid in making the initial opening of the closure.

In still another embodiment, the means for creating the hole in a front wall of the container includes merely an imprinted indication of the location of the hole, such as a small circle with an adjacent text "pierce bag with straw." In this case, the bag must be made of a sufficiently soft material to enable a relatively rigid, plastic straw to press threw it.

It has been determined that a bag having both a front and back wall made of a low density polyethylene film, approximately four mils thick, provides adequate strength to hold a liquid while permitting the point of a rigid straw to pierce the material.

Advantageously, the front wall also has imprinted thereon an indication of the maximum level of liquid to be added to the container. This indication, which may include a dashed line and the associated words "fill line", avoids the possibility that liquid within the container may leak out through the straw hole.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
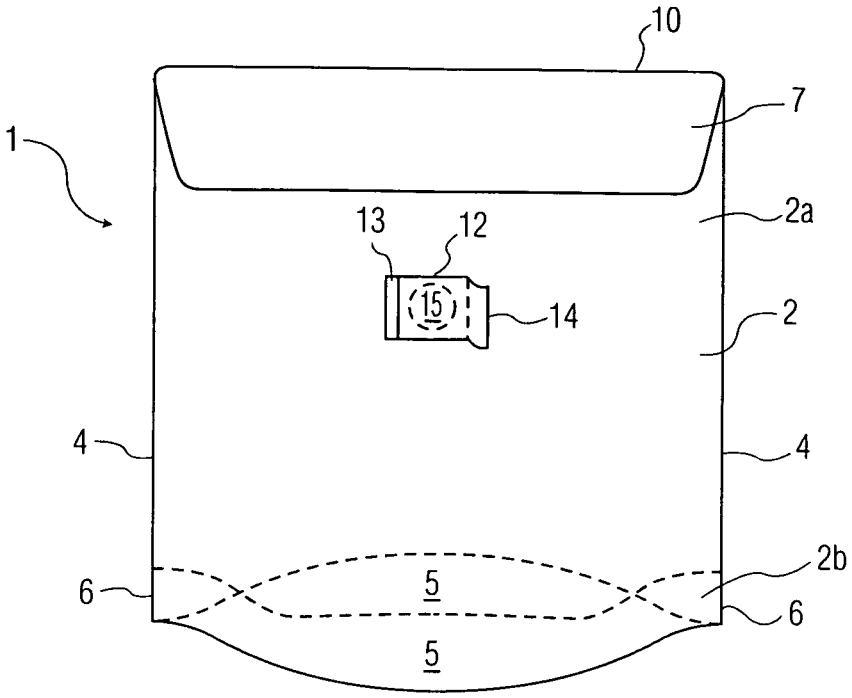
FIG. 1 is a perspective view of the front of one embodiment of a fillable, sealable pouch for a beverage serving, according to the present invention.

The preferred embodiments of the present invention will now be described with reference to FIGS. 1-15 of the drawings. Identical elements in the various Figures are designated with the same reference numerals.

Figure 2:
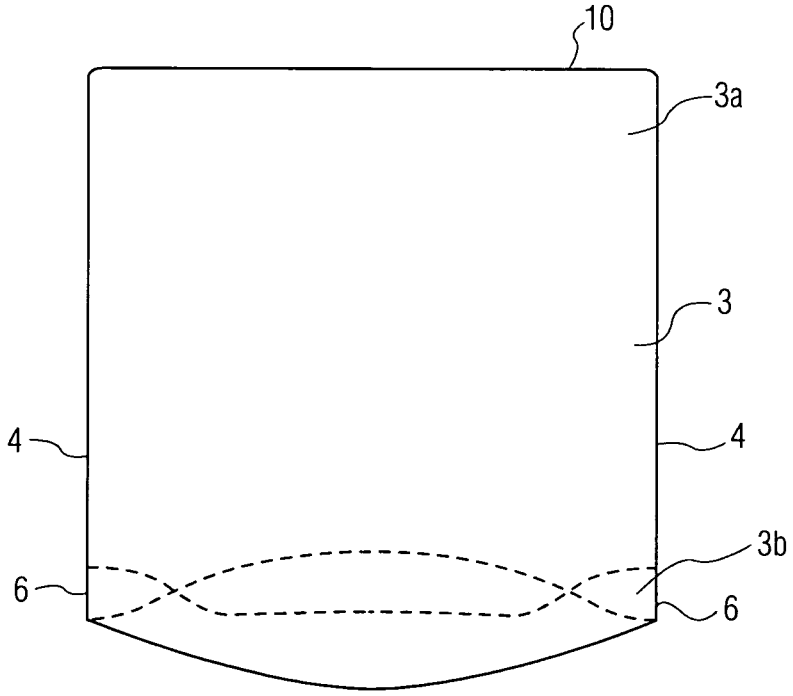
FIG. 2 is a perspective view of the back of the fillable sealable pouch of FIG. 1.

FIG. 1 illustrates the front of the fillable, sealable pouch for a beverage according to the present invention, shown generally at 1. The back of the pouch is illustrated in FIG. 2. The pouch comprises a front wall 2 with an upper portion 2*a* and a lower portion 2*b*; and a back wall 3 comprising an upper portion 3*a* and a lower portion 3*b*. The front and back walls have side edges, 4, which may be secured by heat sealing or adhesive, or a combination thereof. The front and back walls are connected by connecting bottom wall, forming a bottom stabilizing surface 5. The front and back walls, and the connecting bottom wall, are made of plastic and/or foil laminates.

A liquid receiving opening is created in the upper portion of the front and back walls. A bottom stabilizing surface is formed by a generally flat bottom wall, or a pleated or legged stabilizing surface, described in detail below, enables the pouch to stand up, and the liquid receiving opening to maintain an effective diameter while liquid is poured through the opening 9 in FIG. 4.

Figure 3:
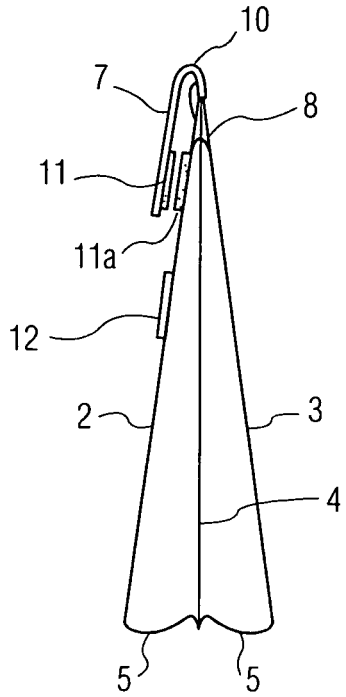
FIG. 3 is the right side view of the fillable, sealable pouch of FIG. 1.

To seal the liquid in the pouch, a liquid-tight seal, such as the Ziploc closure, or mating channel closure, shown at 8 in FIG. 3, may be provided on the inside surfaces of the upper portion of the front and back walls. If desired, a secondary closure 7 may be created by folding the upper portion of the pouch along fold lines 10' and 10" and securing the fold with an adhesive strip 11*b* located on the outside surface of the upper portion of the front wall, above the fold line 10', and a matching strip 11*a* on the front wall 2. If the laminar material of the front and back walls make it difficult to fold the top of the pouch, initial fold lines 10' and 10" on the front wall and back wall, respectively, may be scored during manufacture to facilitate folding to create the secondary seal.

Figure 4:
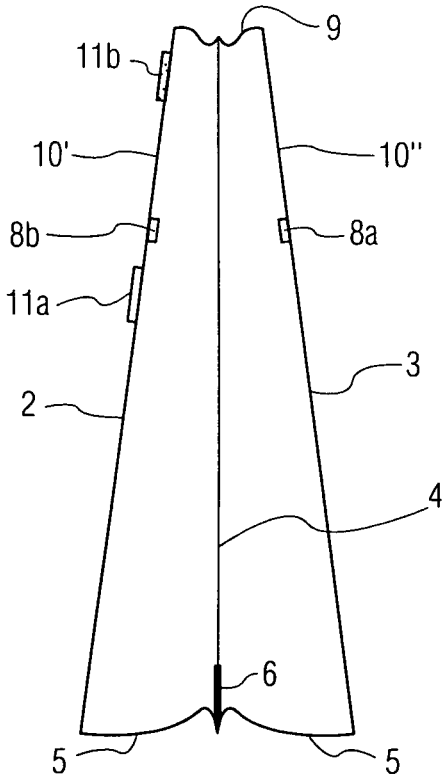
FIG. 4 is a right side view of the fillable, sealable pouch of FIG. 1, opened to be filled.

As shown in FIG. 4, the mating channel closure 8 comprises mating channels 8*a* in the front wall, and 8*b* in the back wall. In an alternative construction, shown in FIG. 6, the initial fluid-tight seal may comprise one or both adhesive surfaces 16*a* and 16*b* on the inner surface of the upper portions of the front and back walls.

Figure 5:
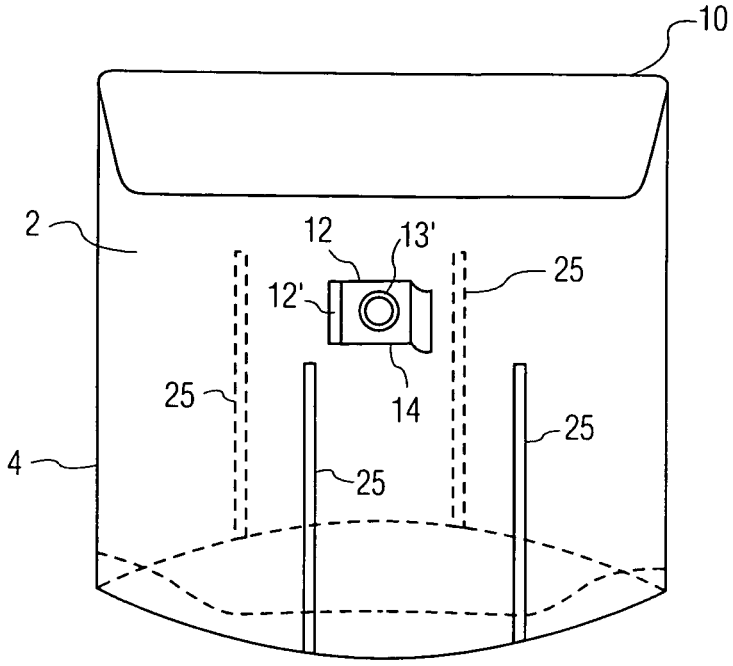
FIG. 5 is a front perspective view of another embodiment of the fillable, sealable beverage pouch of the present invention.
Figure 5A:
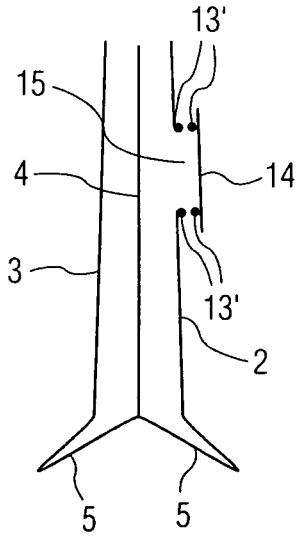
FIG. 5A is a left side view of the beverage pouch of FIG. 5.
Figure 6:
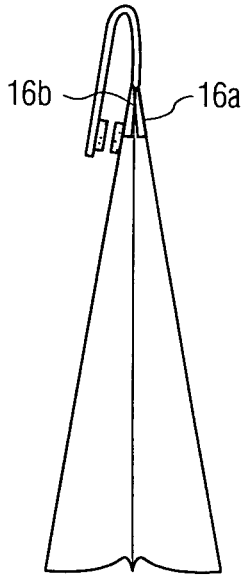
FIG. 6 is a right side view of another embodiment of the fillable, sealable beverage pouch of the present invention.

Shown at 12 in FIGS. 5 and 5A are means for creating a hole in the front wall of the pouch container, created by a hole 15 in the front wall, beneath the upper portion. A removable tab 14 is temporarily, but firmly secured over the hole 15. The tab may be permanently secured to the front wall at region 13' as shown in FIG. 5A.

As shown in FIG. 5, either the front or back wall may be reinforced at lines 25 generally perpendicular to the bottom surface, to assist in maintaining the pouch in an upright position for filling. Also shown in FIG. 5 is an alternative form of the means for creating a hole in the front wall of the container, comprising an adhesive channel closure 12' which mates with a flap on the tab 14.

Figure 7:
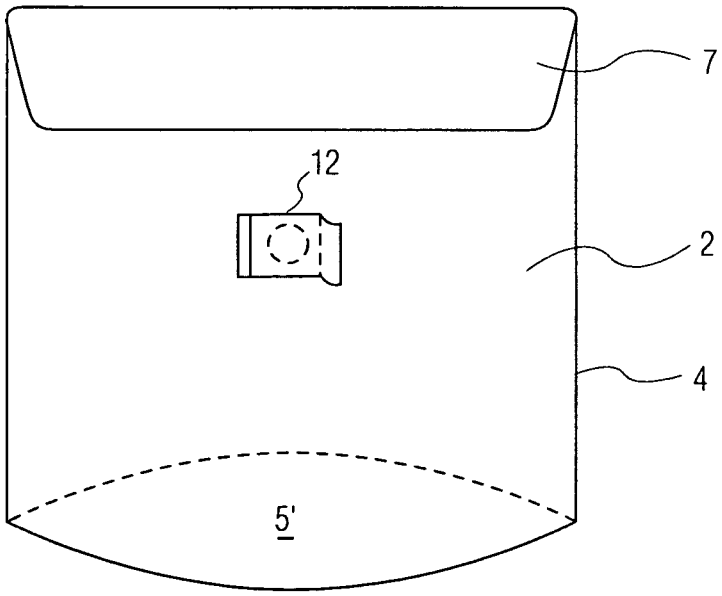
FIG. 7 is a front a perspective view of another embodiment of the fillable, sealable, disposable beverage pouch of the present invention, illustrating a generally ovate shaped, or tear-shaped, bottom surface.

As shown in FIGS. 1, 2, and 4, the bottom surface may be formed by a pleat 6 the edges of which may be heat sealed to each other and to the side edges of the bottom portion of the front and back walls. The inverted pleat created a stabile bottom surface for filling the container. FIG. 5 illustrates an alternative embodiment of the bottom stabilizing surface, comprising a two-legged gusset, created by pleating the connecting bottom wall, and sealing the edges of the pleat to each other, but not to the side edge of the lower portion of the front and back walls. FIG. 7 illustrates another alternative embodiment of the beverage pouch container according to the present invention, in which the bottom stabilizing surface comprises a generally flat bottom surface, 5' comprising a generally ovate or tear-shaped blank.

Figure 8:
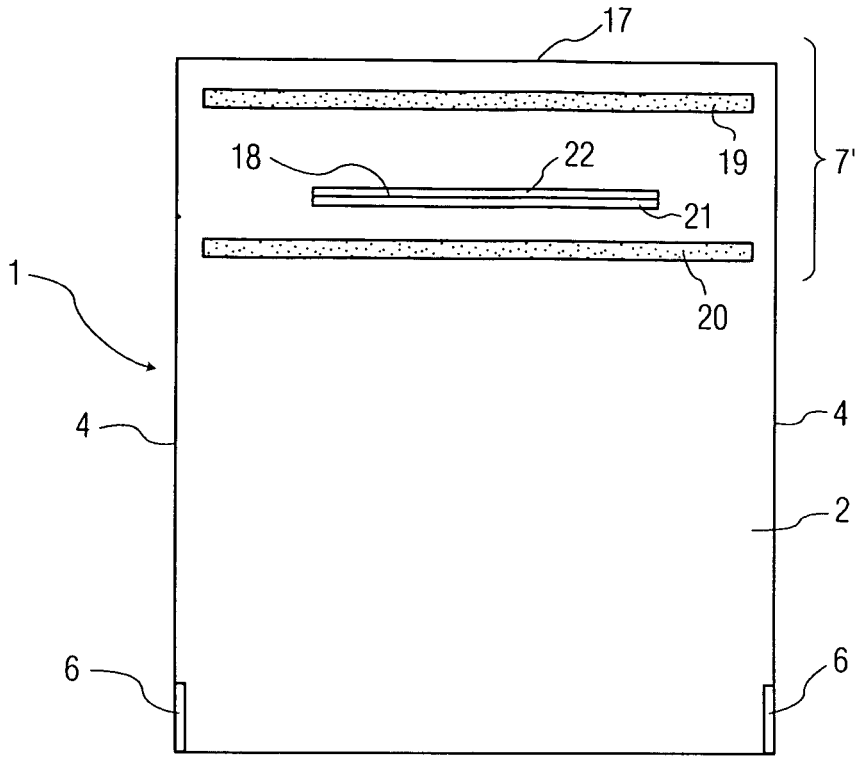
FIG. 8 is a front plan view of another embodiment of the fillable, sealable beverage pouch of the present invention with a Ziploc, mating channel closure in the front wall.
Figure 9:
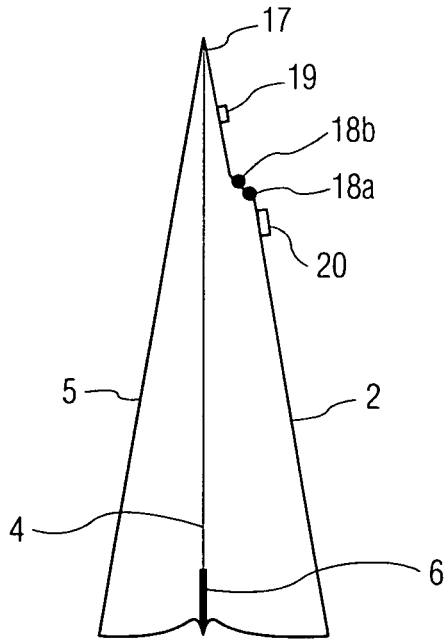
FIG. 9 is a left side view of the pouch of FIG. 8.

FIGS. 8 and 9 illustrate another embodiment of the fillable, sealable beverage pouch container of the present invention, wherein the upper portions of the front and back wall meet at a fold line or top seal 17 and a liquid receiving opening, with a fluid-tight seal, such as a Ziploc closure or mated channel closure 18 provided about the opening in the upper portion of the front wall. Opening the closure 18 permits one to fill the pouch with a liquid, and seal it therein with the fluid tight seal of the mated channel closure 18. If desired, a secondary seal may be made by folding the upper portion of the front and back walls over the front surface of the front wall and securing the fold with adhesive strips 19 and/or 20 on the front wall, above and below the closure, 18.

Figure 10:
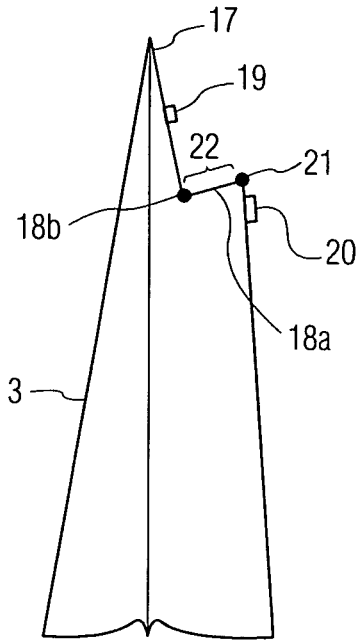
FIG. 10 is a left side view of the pouch of FIG. 8, with the lower portion of the liquid retaining means folded open to increase the liquid receiving opening for filling the container.
Figure 10A:
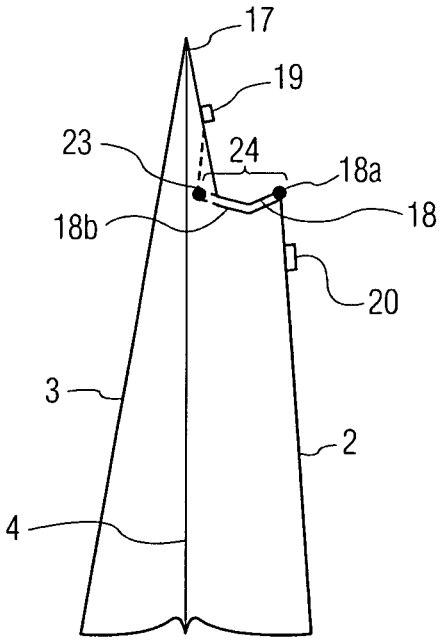
FIG. 10A is a left side view of the pouch of FIG. 8, with the upper and lower portion of the liquid retaining means folded open to further increase the liquid receiving opening for filling the container.

Referring again to FIG. 9, the lower channel 18*a* of the closure 18 may be provided with a score line 21 permitting this lower channel 18*a* to be folded at the score line, projecting the lower channel away from the front wall, to increase the effective pouring diameter of the opening, as illustrated in FIG. 10. In addition, the upper channel, 18*b*, may also be provided with a score line 23 permitting this upper channel to be folded, so as to project inwardly of the front wall, further increasing the effective pouring diameter of the opening, as illustrated in FIG. 10A.

Figure 11:
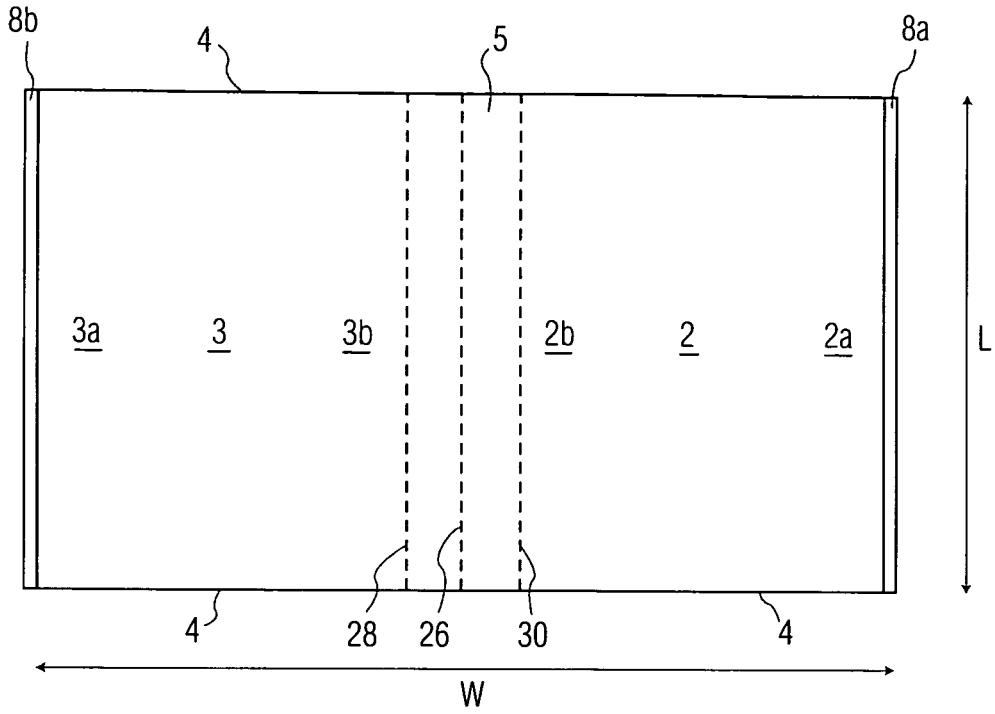
FIG. 11 is a top plan view of a sheet for forming the container of FIG. 1.

FIG. 11 illustrates a blank of fluid impervious material from which one can form the container of FIG. 1. The upper surface of the blank will become the inner surface of the container, and whose lower surface will become the outer surface of the container. As illustrated in FIG. 11, the front wall 2 has an upper portion 2*a* and a lower portion 2*b* and the back wall 3 also has an upper portion 3*a* and a lower portion 3*b*. The blank also has a length 1 and a width w. The width comprises the height of the front and back walls, and the connecting bottom wall. In continuous high-speed production, it is anticipated that the blanks will be cut from a continuous web of fluid impervious material running in the lengthwise direction. Cutting the blank from the running web creates the side edges 4.

To construct the container, the blank must be reverse folded along the center line 26 of the bottom connecting wall. Forward folding the sheet at the line 30 between the front wall and the bottom connecting wall, and forward folding the sheet at the line 28 between the back wall and the bottom connecting wall, forms a pleat in the bottom connecting wall, bringing the inside surfaces of the front and back walls together, and aligning the side edges of the front wall and the back wall.

When the liquid retaining means is a line of adhesive, extending lengthwise of the blank, it may be advantageously provided on the upper (inside) surface of the blank (container) before folding the blank. To complete the container, the side edges must be sealed, preferably by heat sealing. Heat-sealing the side edges secures the pleat along the side edges of the lower portion of the front and back walls. To facilitate the user in creating a straw hole in the front wall, below the liquid retaining seal, the web may be scored, or otherwise provided with a defined line of weakening, preferably before the web is folded.

If the liquid retaining seal is to be a mating channel closure, to create a re-closeable seal, an edging sheet of fluid impervious material, carrying one half of a mating channel closure 8*a* may be provided along one the length of the web, and the other half of the mating channel closure 8*b* provided on an edging sheet along the other length of the web, and the edging sheets secured to the lengthwise edges of the web.

Similarly, if the straw hole is to be re-closeable, one half of a mating channel closure 8*a* may be provided and attached to the outer surface of the front wall 2 (under surface of the web), with the other half of the mating channel closure 8*b* preferably provided in atop the first half, and secured thereto by closing the channel. The attachment is preferably done after the web is folded along line 30, bringing the outer surface of the front wall to an "up" position.

In another embodiment of the container it may be desired to create a two-legged gusset at the bottom surface, rather than a pleat. This may be accomplished by heat sealing the side edges of the lower portion of the front and back walls to the edge between lines 26 and 30, and lines 28 and 30, respectively. As with the pleat, this may be accomplished before or after the heat-sealing of the remainder of the side edges of the front and back walls. In certain embodiments of the invention, it may be desirable to provide a transparent material as at least a portion of the back wall. Preferably, a fill line may be provided at the transparent portion, to indicate the maximum height of liquid that can be easily sealed in the container by the fluid retaining seal.

Figure 12:
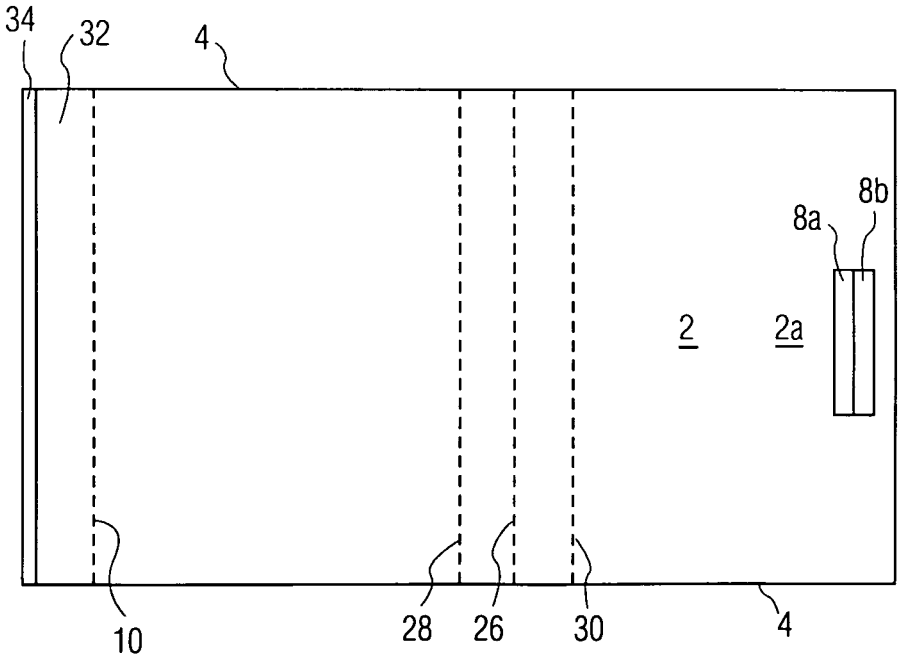
FIG. 12 is a top plan view of a sheet for forming the container of FIG. 8.

FIG. 12 illustrates a sample blank for forming the container of FIG. 7. The blank may be folded and sealed as the blank in FIG. 11, to form the bottom stabilizing surface, however, the liquid receiving opening in this container is not between upper portions of the front and back walls, but in the upper portion of the front wall. The liquid retaining seal in this embodiment is a mating channel closure, 8*a* and 8*b*, such as a "Ziplock™" closure. A section of the mating channel closure may be attached to the upper portion of the front wall, on either the inside surface (upper surface of the web) or the outside surface (underside of the web) of the front wall. Preferably a line of weakening is provided in the front wall, along the section of the closure, and a midsection tab may also be provided to assist in opening the closure and creating the liquid receiving opening within the opened mating channel closure section. The front and back walls must be secured, as by heat-sealing, to form the container with opening in the upper front wall. As it may be advantageous to perform these steps nearer the lengthwise edge of the web, the lines 26, 28 and 30 may be off-set toward the right edge of the web, creating a flap 32 between the top edge 10 of the container, and the left edge of the blank. Following folding of the blank, the flap 32 may be brought adjacent the upper portion of the front wall (inside or outside surface), and attached thereto, as by heat-sealing along the edge 34 of the flap 32.

Figure 13:
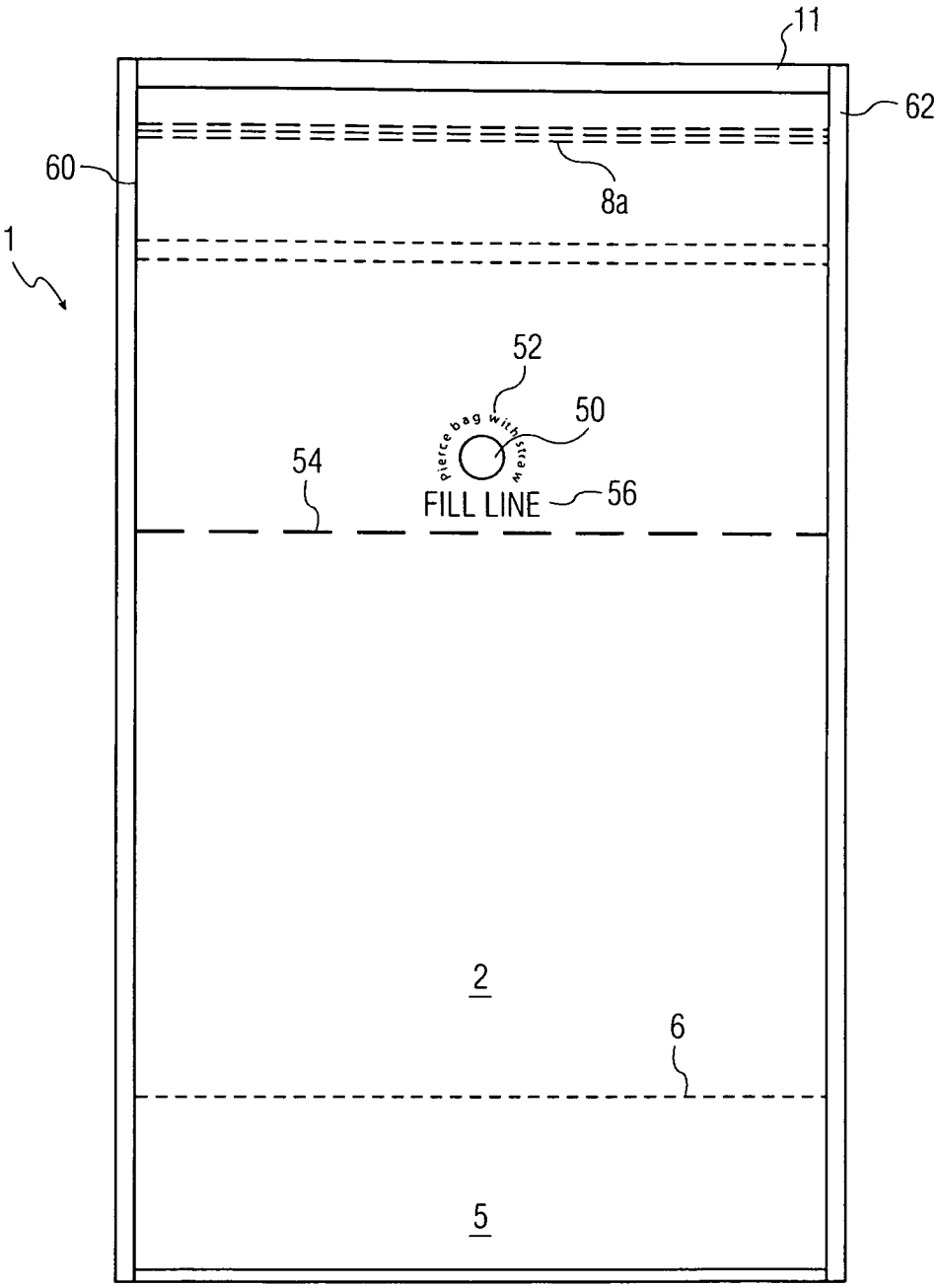
FIG. 13 is a plan view of the front of still another embodiment of a fillable, sealable pouch for a beverage serving, according to the present invention.
Figure 14:
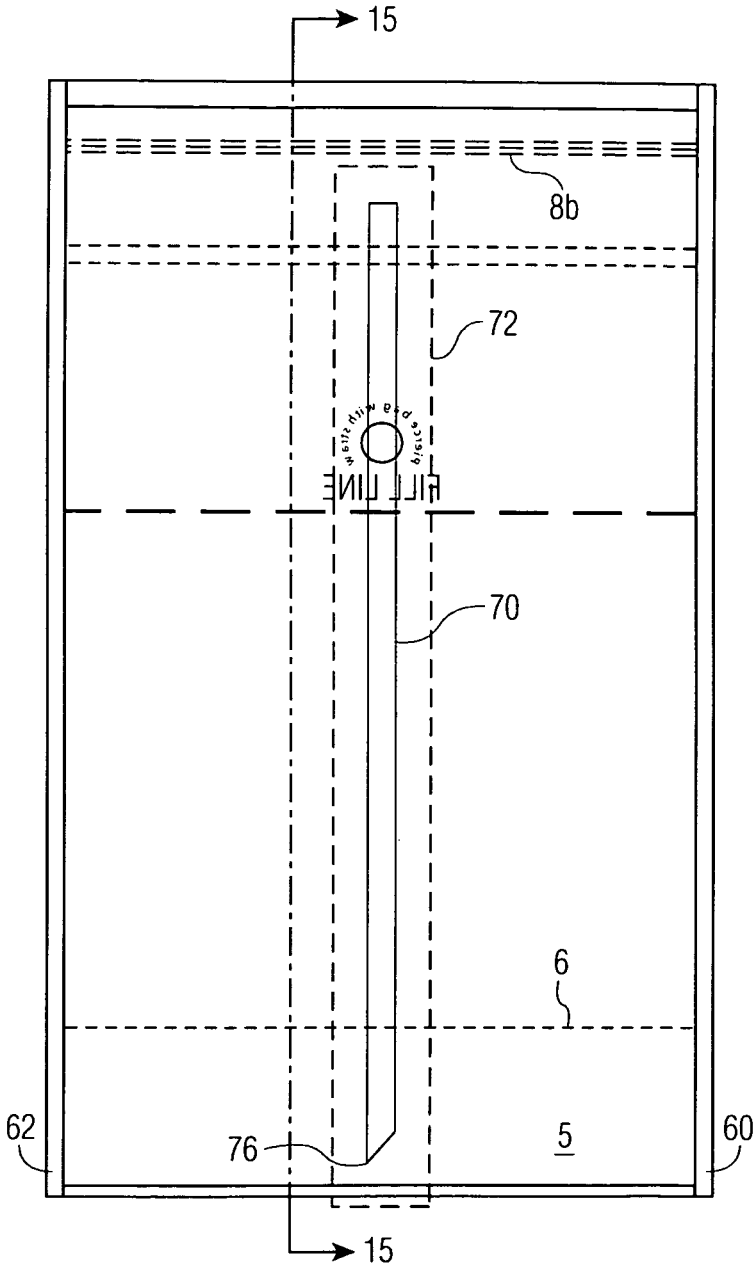
FIG. 14 is a plan view of the back of the fillable, sealable pouch of FIG. 13.
Figure 15:
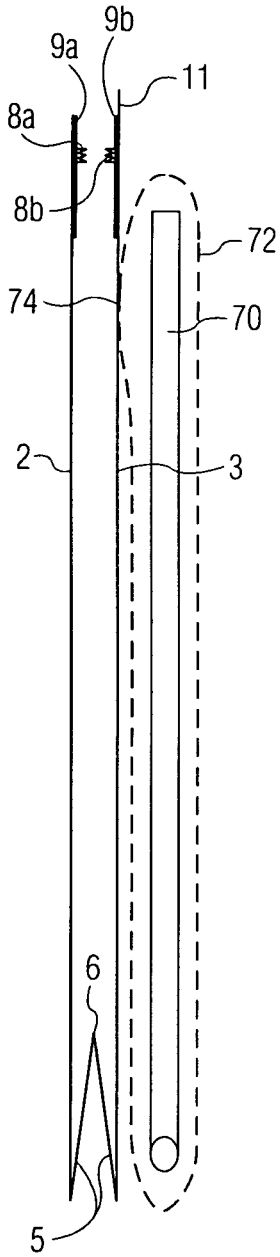
FIG. 15 is a cross-sectional view of the fillable, sealable pouch of FIGS. 13 and 14, taken along the line 15-15 in FIG. 14.

FIGS. 13-15 illustrate still another embodiment of the fillable, sealable pouch according to the present invention. FIG. 13 shows the front, FIG. 14 shows the back and FIG. 15 shows a cross-sectional view taken along the line 15-15 in FIG. 14. As illustrated in these figures, the pouch 1 comprises a Ziplock closure formed of closure elements 8*a* on the back of the front panel 2 and 8*b* on the front of the back panel 3. These mating closures have been formed on a separate strip of foil material 9*a* and 9*b*, respectively, which is laminated onto the opposing, inside surfaces of the front and back walls, respectively.

As is best illustrated in FIG. 15, the back wall 3 extends upward slightly above the front wall 2, providing a convenient flap or lip 11 that may be grasped by the user to separate the tops of the front and back walls when filling the bag.

The front and back walls are heat sealed together at their side edges to form seams 60 and 62.

As in the case of the previous embodiments described above, the lower edges of the front and back walls are connected by a bottom strip 5 that is folded to provide a pleat 6. When the bag is filled with liquid, the bottom strip separates to form a stabilizing bottom surface for the pouch.

According to a novel aspect of the invention, the means for creating a straw hole in the front wall of the container is an imprinted indication of the location of the place to be pierced by the straw. For example, this imprinted indication may be simply a circle 50 and associated text 52, "pierce bag with straw", as indicated in FIG. 13. In this case, the front wall must be made of a relatively soft material that can be pierced by a relatively rigid straw.

To avoid leakage of liquid through the opening formed by the straw, the front wall of the pouch is also preferably printed with an indication of the maximum level of liquid. This imprinted indication, which may be a dashed line 54 with associated text 56, "fill line", is provided on the front wall below the means for creating a straw hole, as viewed in the manner shown in FIG. 13.

As shown in FIGS. 14 and 15, a straw 70, encased in a cellophane wrapper 72, is preferably attached to the back wall 3 of the pouch. The wrapper 72 may be attached at one or more points 74 on the back wall 3 by heat sealing or by means of an adhesive.

As is best illustrated in FIG. 14, the bottom of the straw 70 is cut at an angle to form a point 76. To drink liquid from the pouch, a user removes the cellophane wrapping 72 from the back wall of the pouch, opens it, and removes the straw 70. The point 76 of the straw is then pressed against the front wall of the pouch at the location 50 to pierce the wall and gain access to the liquid.

Preferably, both the front and back walls of the pouch are made of a low density polyethylene (LD PE) film or sheet material which is approximately four mils thick. The LD PE preferably has a linear low density (LLD) additive in the amount of approximately 30% by weight for durability and strength. The sheet material, so formulated and sized, is sufficiently soft, at room temperature, to be pierced by the plastic straw. It is also designed to be refrigerated or frozen without becoming brittle.

The straw is preferably made of an FDA approved polypropylene with a wall thickness of approximately 40 mils. The outside diameter of the straw may be approximately 4.5 mm and its total length may be approximately 140 mm.

It can be readily understood that the containers of the present invention will provide an inexpensive alternative to pre-packaged juice boxes, generally considered to be manufactured for children. The container of the present invention will provide the convenience of a prepackaged drink for adults. This is of increasing importance as adults increasingly commute to work and/or school, and work "flex-hours", requiring them to get meals away from home, on a train, in the car, and at odd hours. The container of the present invention can provide "a cup of milk" to pour into the makeshift cereal bowls made from boxes of individual servings of cereal. In addition, larger volume containers can be used to supply the favorite sports drink, when needed, whether or not the manufacturer had seen fit to so package the drink, and the local store carries that size, or is open at the hour the container of favored beverage is desires. For many yet undiscovered uses, the container of the present invention may be used to substitute those beverages of choice, required for health maintenance, or for a particular diet, for adults or their children.

There has thus been shown and described a novel disposable seal and lock beverage pouch which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, modifications, variations and other uses and applications which do not depart from the spirit and scope of the invention are deemed to be covered by the invention, which is to be limited only by the claims which follow.

What is claimed is:

1. A fillable, sealable, disposable container for a liquid, comprising:

1) opposed front and a back walls formed of a fluid-impervious plastic film material of given thickness, each wall having an upper portion, opposed side edges, and a lower portion, said front and back walls being joined along the opposed side edges, wherein at least the front wall is formed of a single layer sheet of a low density polyethylene;

2) a bottom stabilizing surface, comprising a connecting lower wall, connecting the lower portions of the front and back walls;

3) a liquid receiving opening the upper portions of the front and back walls;

4) a sealable fluid-tight liquid retaining seal about said opening, for sealing the upper portion of the front and back walls, to retain liquid in the container;

5) printed indicia for a straw hole on the front wall of the container, located beneath the liquid retaining seal in the upper portion of the front wall, said printed indicia providing an imprinted indication on the film material of the location to be pierced by an external straw; and 6) printed indicia on the front wall, below said indicia for a straw hole, providing an imprinted indication of the maximum level of liquid to be added to the container;

wherein said plastic film material is flat and uncut at the location of the printed indicia and is of such material and such given thickness as to be pierceable by a rigid plastic straw at the location of the printed indicia; and wherein said liquid receiving opening maintains an effective pouring diameter, while the container is supported on its bottom stabilizing surface.

2. A fillable, sealable, disposable container for a liquid as in claim 1, wherein the sealable fluid-tight liquid retaining seal is a mating channel closure.

3. A fillable, sealable, disposable container for a liquid as in claim 2, further comprising a protective secondary seal, comprising an adhesive sealing line on the outside surface of the upper portion of the front wall, for attaching the outer surface the front wall to itself, by folding the upper portions of the front and back walls onto the front wall and securing the fold with an adhesive seal.

4. A fillable, sealable, disposable container for a liquid as in claim 1, wherein the sealable fluid-tight liquid retaining seal is an adhesive sealing line on the inside surface of the upper portion of at least one of the front wall and the back wall.

5. A fillable, sealable, disposable container for a liquid as in claim 4, further comprising a protective secondary seal, including an adhesive sealing line on the outside surface of the upper portion of the front wall, for attaching the outer surface the front wall to itself, by folding the upper portion of the front and back walls onto the front wall and securing the fold with an adhesive seal.

6. A fillable, sealable, disposable container for a liquid as in claim 1, wherein the bottom surface comprises a gusset between the front and back walls, one portion of the gusset being sealed to the lower portion of the front wall, and another portion of the gusset being sealed to the lower portion of the back wall, along their side edges.

7. A fillable, sealable, disposable container for a liquid as in claim 1, wherein the bottom surface comprises a pleat between the front and back walls, sealed to the lower portion of the front and back walls, along their side edges.

8. A fillable, sealable disposable container for liquid as in claim 1, wherein the imprinted indication is a circle imprinted on front wall.

9. A fillable, sealable, disposable container for a liquid as in claim 1, wherein the polyethylene film material is approximately 4 mils thick.

10. A fillable, sealable, disposable container for a liquid as in claim 1, further comprising a rigid straw, having a pointed end for piercing the polyethylene film, attached to the at least one of the front and back walls.

11. A fillable, sealable, disposable container for a liquid as in claim 10, wherein the rigid straw is made of polypropylene.

12. A fillable, sealable, disposable container for a liquid as in claim 1, wherein the printed indicia providing an imprinted indication of the maximum level of liquid to be added to the container is a dashed line.

* * * * *